US005104181A

United States Patent [19]

Lange

[11] Patent Number: 5,104,181

[45] Date of Patent: Apr. 14, 1992

[54] CONTOUR LOUNGER WITH FLOOR-CONTACTING LANDING GEAR

[75] Inventor: Glenn A. Lange, Huntingburg, Ind.

[73] Assignee: Best Chairs, Inc., Ferdinand, Ind.

[21] Appl. No.: 624,654

[22] Filed: Dec. 10, 1990

[51] Int. Cl.[5] ..... A47C 1/02

[52] U.S. Cl. ..... 297/68; 297/271

[58] Field of Search ..... 297/259, 83, 85, 84, 297/68, 258, 270, 89, 271, 432, 433, 434, 435, 436

[56] References Cited

U.S. PATENT DOCUMENTS 959,949 5/1910 Leipert ..... 297/271 X
1,228,967 6/1917 Rho ..... 297/271 X
3,101,971 8/1963 Hampton .
3,282,626 11/1966 Hampton .
3,322,459 5/1967 Hampton .
3,537,747 11/1970 Rogers, Jr. .
3,730,585 5/1973 Rogers, Jr. et al. .
3,743,349 7/1973 McDonald et al. .
3,767,257 10/1973 Rogers, Jr. et al. .
3,904,240 9/1975 Rogers, Jr. et al. .
3,926,472 12/1975 Evans .
4,319,780 3/1982 Rogers, Jr. .
4,707,025 11/1987 Rogers, Jr. .

*Primary Examiner*—Laurie K. Cranmer
*Attorney, Agent, or Firm*—Wood, Herron & Evans

[57] ABSTRACT

A contour lounger with floor-contacting landing gear is disclosed which provides rocking and reclining capability. The contour lounger is constructed of a standard legless rocking chair and has added thereto a footrest, footrest linkage, a landing gear, and landing gear linkage.

6 Claims, 3 Drawing Sheets 4
4

CONTOUR LOUNGER WITH FLOOR-CONTACTING LANDING GEAR

BACKGROUND OF THE INVENTION

1. Field of Invention

The present invention relates to improvements in rocking chairs and more specifically to an improved legless rocking chair having reclining capability.

2. Description of Prior Art

A typical rocker recliner chair has a floor supported base, a rocking frame mounted on the base for rocking movement, and a seat frame with linkage supporting the seat frame from the rocking frame for movement between an upright position and a reclined position. The typical rocker recliner chair also has a backrest either fixed to the seat or connected to the seat via a linkage which permits relative pivotal movement between the seat and backrest. Irrespective of whether the backrest is movable or fixed to the seat, rocker recliners usually have a movable footrest with linkage mounting the footrest to the seat frame for movement between a retracted position and an extended position. In this type of chair, a locking linkage is often provided between the footrest linkage, seat frame and rocking frame for preventing rocking movement when the footrest is extended or the seat is in the reclining position. Generally this locking linkage takes the form of a landing gear which when actuated contacts the chair base, or in some cases is restrained within a keeper mounted on the chair base. In any event, this landing gear of the typical rocker recliner is mounted in an aftmost location and prevents further rocking or reclining movement once the chair is in the reclined position.

The complexity and numerosity of linkages necessary to carry out the rocking and reclining functions as well as the locking against rocking function in this typical prior art chair results in a relatively expensive product. It has therefore been one object of the present invention to provide a rocker recliner chair of a simplified design wherein the bulk of the mechanical apparatus of the typical rocker recliner is eliminated.

Another object of the present invention is to provide a legless type rocking chair with the added features of reclining and supporting of the legs and feet.

Yet another object of the present invention is to allow a manufacturer of legless rocking chairs to include within his product line a legless rocker recliner having a footrest and associated linkage and a landing gear to prevent rocking movement when the footrest is extended.

SUMMARY OF THE INVENTION

The present invention is a legless rocker recliner chair having an extendible footrest, an extendible floor-contacting landing gear and a handle for actuating the footrest and landing gear. The chair, commonly called a contour lounger, has a frame including a pair of arcuate surfaces which are engagable directly with the floor surface and on which the chair rocks. In addition the frame defines a chair seat and a chair backrest. The footrest of the present contour lounger is extendible from a retracted position which is generally vertically oriented and positioned closely adjacent the front of the chair to an extended position generally horizontally oriented and substantially forward of the chair. A pair of footrest linkages are provided for moving the footrest from the retracted position to the extended position. An anti-rock lock in the form of a floor-contacting landing gear is included which is extendible to a position below the arcuate surfaces of the chair frame. A linkage is also provided which moves the landing gear from the retracted position to the extended position. To operate the footrest and the landing gear, the handle is rotated which simultaneously actuates both linkage mechanisms.

The landing gear linkage is a standard four bar linkage. A transverse brace is mounted between the sides of the chair frame slightly above the arcuate rocking surfaces. Attached medially along the length thereto is a bracket, which provides a pivot point for a first link. The first link is pivotally connected to a second link, this pivot connection serving to support the landing gear. The other end of the second link is pivotally connected to a third link which in turn is fixedly connected to a transverse driver bar medially along its length. The handle of the chair is fixedly connected to an end of the transverse driver bar. The fourth fixed, or frame link of the four bar linkage is an imaginary link spanning between the bracket pivot and the rotatable driver bar effectively grounding the linkage to the chair frame.

As previously mentioned, the pivotal connection between the first and second links of the landing gear four bar linkage is the support point for the landing gear. The landing gear may be in the form of a wheel or roller, the axis of rotation of which is colinear with the pivot axis of rotation.

When the handle is rotated, the footrest and landing gear are simultaneously placed in their respective extended positions. Consequently, the chair is caused by the landing gear to be rocked rearwardly into a generally reclined attitude. The landing gear then renders the chair incapable of any further rocking motion.

The present invention has numerous advantages. A rocker recliner chair is provided which is relatively inexpensive to manufacture and easily assembled, and which provides the desired rocking and reclining motions of much more expensive and complex rocker recliners.

A further advantage of the present invention is that a rocking chair of unit construction has included therewith the additional desirable features of means to support the feet and legs of an occupant, and, means to recline the chair and lock the chair against further rocking motion.

Yet a further advantage of the present invention is that a manufacturer of legless rockers may inexpensively incorporate into his product line a recliner chair.

These and other objects and advantages of this invention will more readily become apparent from the following description of the drawings, in which:

DESCRIPTION OF PREFERRED EMBODIMENTS

Figure 2:
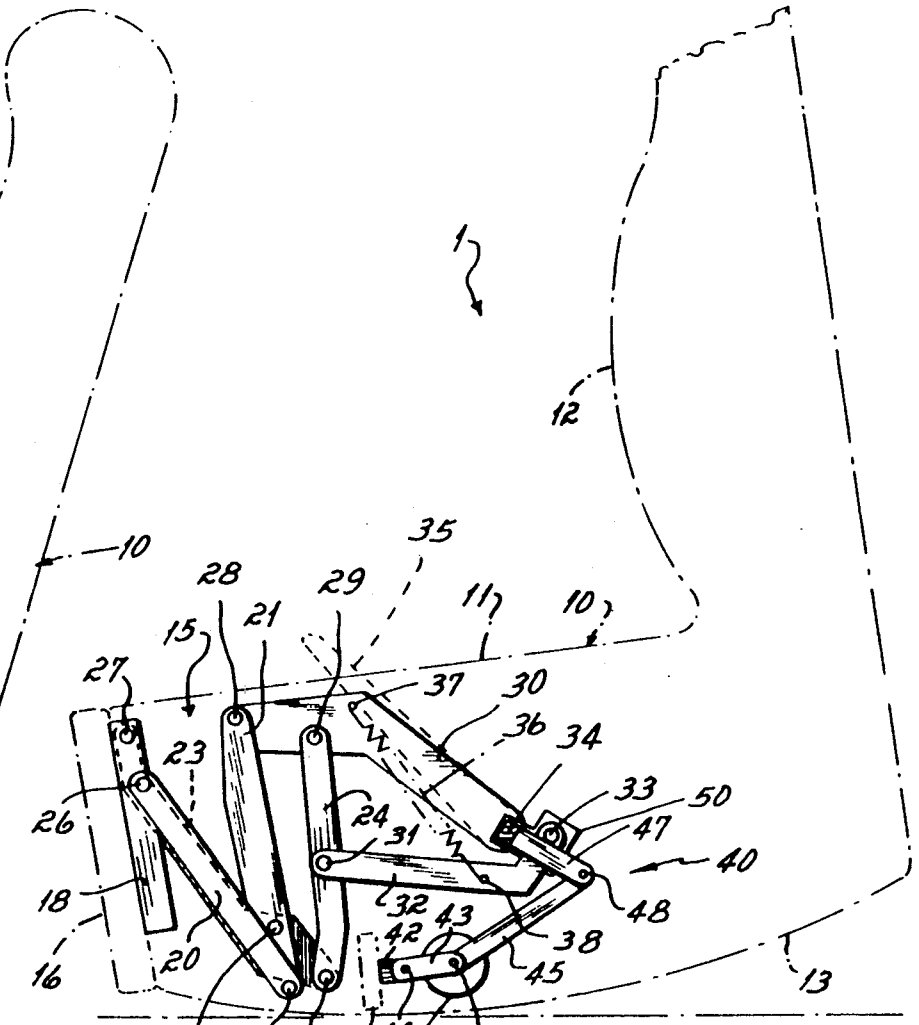
FIG. 2 is a side elevational view similar to FIG. 1 but with the chair in a position rocked forwards and with the footrest and landing gear retracted.
Figure 1:
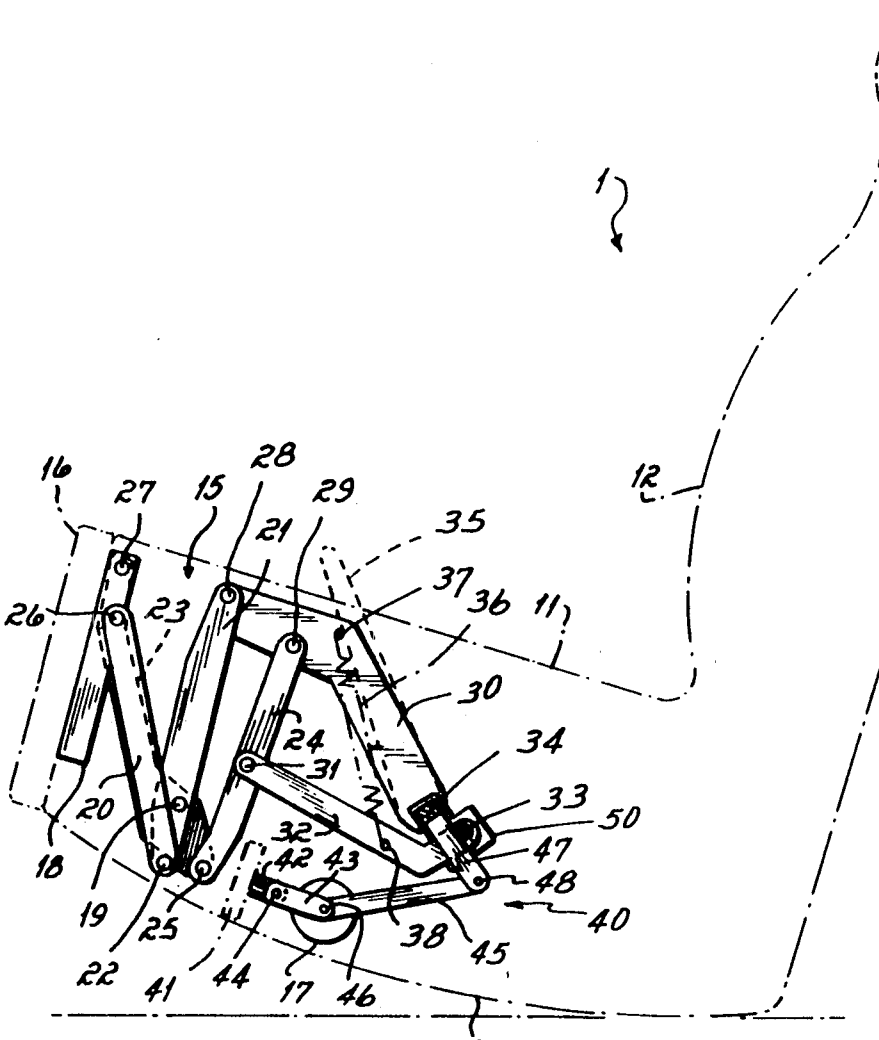
FIG. 1 is a side elevational view of a contour lounger embodying the present invention with the chair illustrated in phantom lines and in a position of being rocked backwards with the footrest and landing gear retracted.
Figures 3, 4:
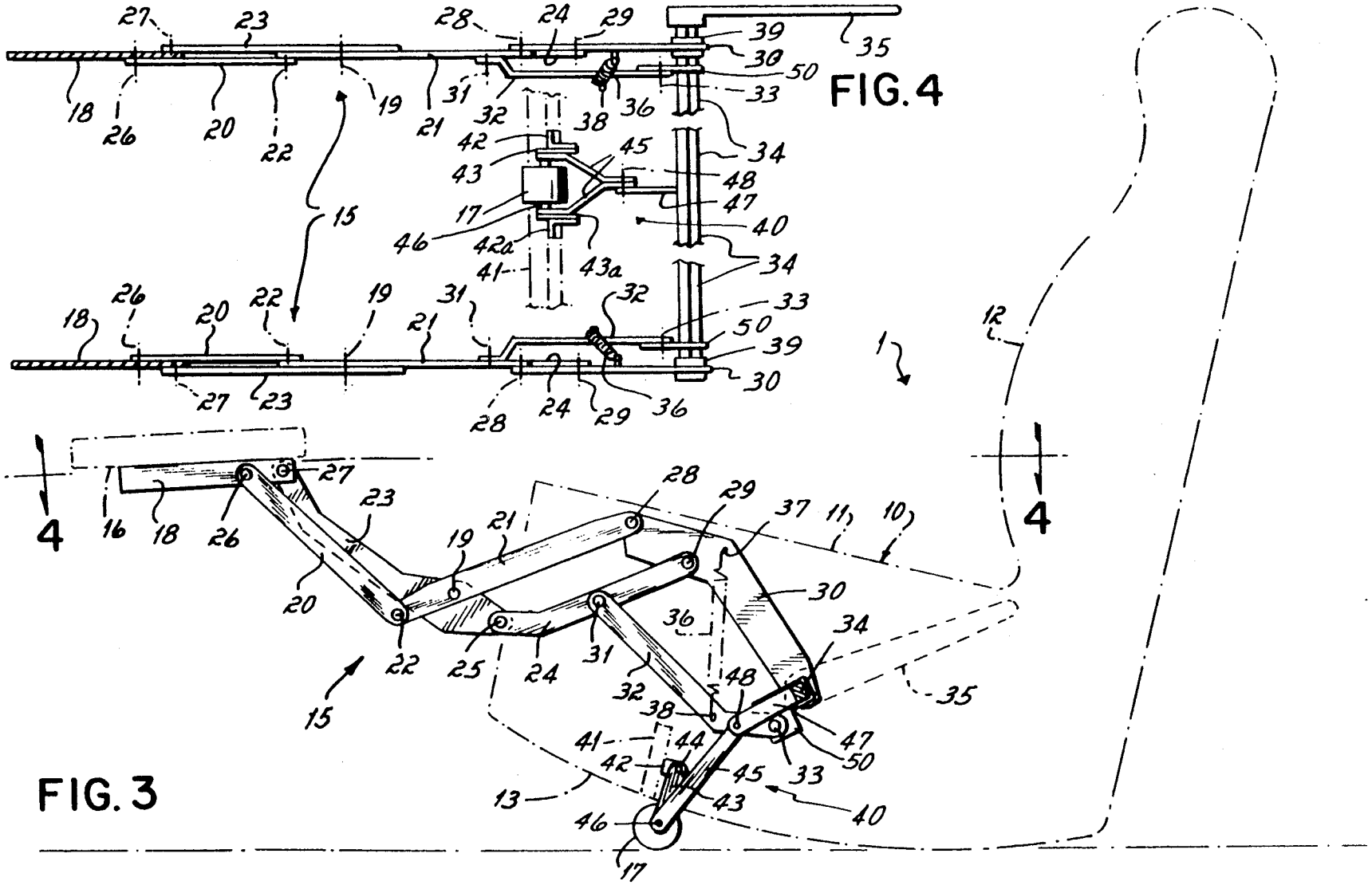
FIG. 3 is a side elevational view of the contour lounger of FIGS. 1 and 2 in the reclined position with the footrest and landing gear extended.
FIG. 4 is a view taken along lines 4—4 of FIG. 3.

Referring first to FIGS. 1-3, there is illustrated a contour lounger 1 embodying the invention of this application. The contour lounger 1 comprises a chair frame 10 which includes a seat 11, a backrest 12, and a pair of arcuate rocking surfaces. Since the chair frame 10 per se is conventional and known in the prior art, it is illustrated in the drawings in phantom lines. However, it is to be understood that the frame 10 of contour lounger 1 includes appropriate spring elements, cushioning, upholstery, and the like for completion of a saleable product.

Supported upon the chair frame 10 is a footrest linkage assembly 15 for effecting movement of a footrest 16 between a retracted position illustrated in FIG. 1 and an extended position illustrated in FIG. 3. The footrest linkage assembly of the invention includes a novel landing gear anti-rock lock 17. While only one footrest linkage assembly is illustrated in FIGS. 1-3, it is to be understood that as may be seen in FIG. 4, an operable recliner lounger has a pair of footrest linkages 15, each linkage of the pair being located adjacent a side of the chair. In other words, only one footrest linkage assembly is illustrated in FIGS. 1-3 in order to avoid confusion. The footrest linkage assembly 15 is in the form of a scissors or double-V linkage of the conventional overlapped style. The footrest linkage assembly 15 includes links 20, 21 that form a front V-pair pivotally interconnected by a pivot 22, and links 23, 24 that form a rear V-pair pivotally interconnected by a pivot 25. The rear link 21 of the front V-pair is pivotally connected to the front link 23 of the rear V-pair by a pivot 19. The front links 20, 23 of each V-pair are pivotally connected by pivots 26, 27 to the footrest frame mounting plate 18 and hence, to footrest 16. The rear links 21, 24 of each V-pair are pivotally connected by pivots 28, 29 to footrest linkage support arm 30, which is fixedly attached to the inside of the chair frame 10. The rear link 24 of the rear V-pair 23, 24 is pivotally connected by a pivot 31 intermediate of its length to a front end of footrest linkage driver arm 32. The rear end of footrest linkage driver arm 32 is pivotally connected to a front end of a footrest linkage driver link 50 by a pivot 33, with the rear end of driver link 50 being fixedly connected to a transverse, horizontally oriented driver bar 34 (cross-hatched in FIGS. 1-3). Each driver link 50 of the pair of footrest linkages is non-rotatably keyed to the driver bar 34 near an end of the driver bar 34. The ends of the driver bar 34 are rotatably journaled within journal blocks or bushings 39, 39 which are in turn mounted in the footrest linkage support arms 30, 30. A handle 35 is fixedly connected to an extension of the bar 34 extending outboard of a side of the chair frame 10, thereby being operable to simultaneously actuate each linkage of the pair of linkages. It is preferred that a tension spring 36 be secured at one end 37 to support arm 30 and at its opposite end 38 to the driver arm 32. As will be seen from the description below in conjunction with reference to FIG. 3, the spring 36 provides a force on driver arm 32 which aids in the extension of the footrest linkage 15 and maintains the linkage 15 in the extended condition.

Landing gear anti-rock lock 17 is preferably shaped as a wheel or roller, and is actuated by the landing gear anti-rock lock linkage assembly 40 which takes the form of a standard four-bar linkage. This linkage is perhaps best illustrated in FIGS. 1 and 2. Referring to FIGS. 1 and 2, a transverse brace 41 is fixedly mounted between the sides of the chair frame 10 slightly above the arcuate rocking surfaces 13. Mounted to the transverse brace 41 medially along its length is a bracket 42. A first link 43 is pivotally connected on its front end by pivot 44 to bracket 42, and pivotally connected on its rear end to a front end of a second link 45 by pivot 46. The anti-rock lock 17 is rotatably mounted upon this pivot 46. The rear end of the second link 45 is pivotally connected to a front end of a driver link 47 by pivot 48. The rear end of driver link 47 is fixedly connected to the transverse driver bar 34 medially along the driver bar's length. The fourth fixed, or frame link of the four bar linkage is an imaginary link spanning between pivot 44 of the bracket 42 and the rotatable driver bar 34, the four bar linkage effectively being grounded to the chair frame.

With reference to FIG. 4, it will be seen that bracket 42 comprises a pair or right angle brackets 42 and 42*a* fixedly attached to the rear side of the transverse brace 41. The first link 43 comprises a pair of links 43 and 43*a*, the ends of which are pivotally connected to the brackets 42 and 42*a* respectively, by means of pivots 44 and 44. The other ends of the links 43 and 43*a* are pivotally connected to the ends of yoke links 45 and 45 by means of pivots 46, essentially an axle on which the anti-rock lock 17 rotates. The other end of the yoke links 45 and 45 are pivotally connected to the driver link 47 by means of pivot 48. The other end of the driver link 47 is fixedly connected to the transverse driver bar 34, the ends of which are journaled in bushings 39 and 39 which are press-fitted into holes in the footrest linkage support arms 30 and 30.

Figures 5, 6:
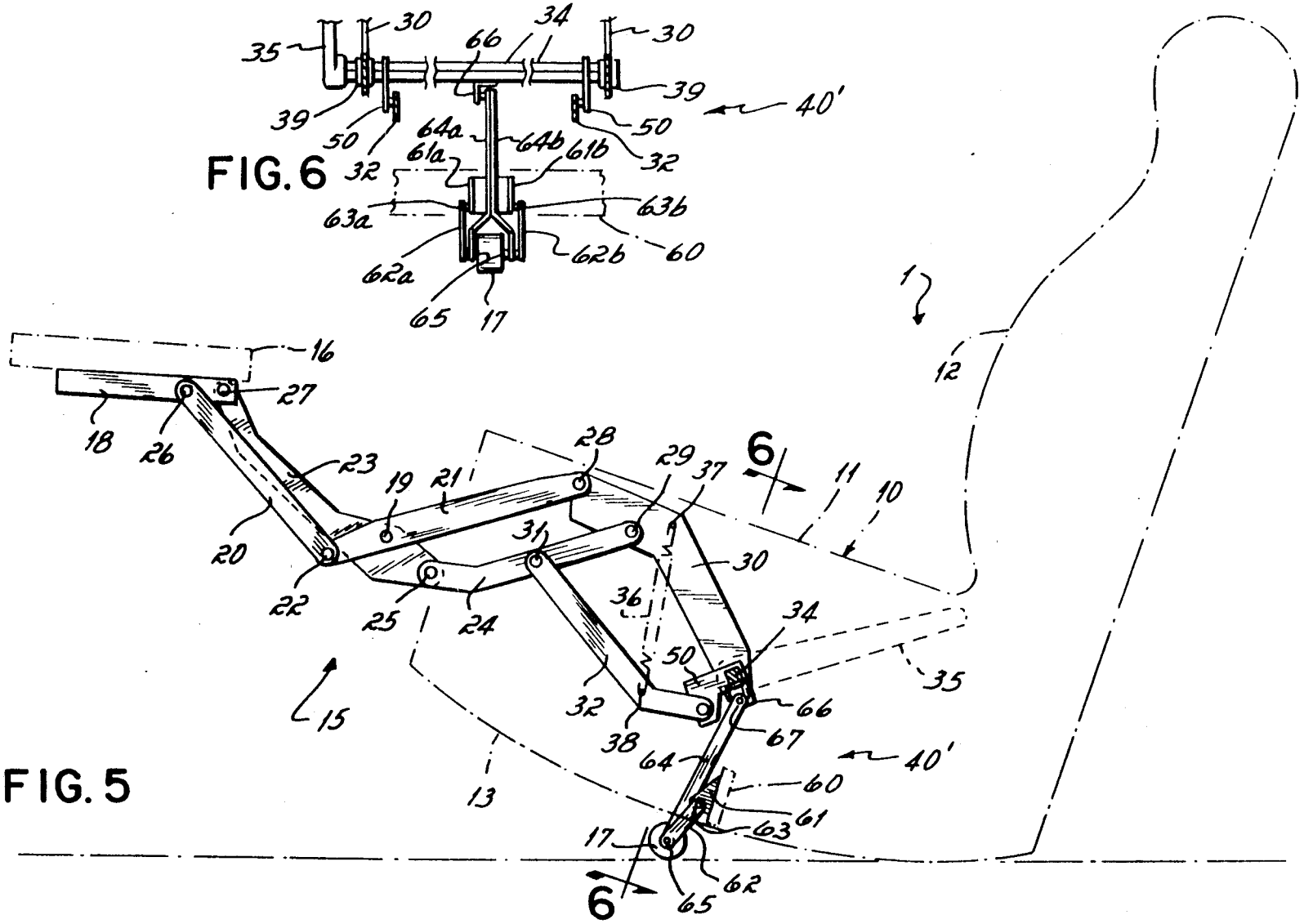
FIG. 5 is a side elevational view of an alternative embodiment of the landing gear linkage.
FIG. 6 is a view taken along lines 6—6 of FIG. 5.

An alternative embodiment of the landing gear anti-rock lock linkage assembly 40 is shown in FIGS. 5 and 6. The linkage assembly 40' in this embodiment is likewise a four bar linkage, but the linkage assembly 40' is oriented to provide a chair occupant greater leverage by way of the landing gear anti-rock lock 17. In this embodiment, a transverse brace 60 is fixedly mounted between the sides of the chair frame 10 slightly above the arcuate rocking surfaces 13, but in a more rearward direction than that of the embodiment of FIGS. 1 and 2. Mounted to the forward side of the transverse brace 60 medially along its length is a bracket 61. A first link 62 is pivotally connected on its rear end by pivot 63 to bracket 61, and pivotally connected on its front end to a lower end of a second link 64 by pivot 65. The anti-rock lock 17 is rotatably mounted upon this pivot 65. The upper end of the second link 64 is pivotally connected to a lower end of a driver link 66 by pivot 67. The upper end of this driver link 66 is fixedly connected to the transverse driver bar 34 medially along the driver bar's length. The fourth fixed, or frame link of the four bar linkage is an imaginary link spanning between pivot 63 of a bracket 61 and the rotatable driver bar 34, the four bar linkage effectively being grounded to the chair frame.

With reference to FIG. 6, it will be seen that the bracket 61 comprises a pair of right angle brackets 61*a* and 61*b* fixedly attached to the front side of the transverse brace 60. The first link 62 comprises a pair of links 62*a* and 62*b*, the ends of which are pivotally connected to the brackets 61*a* and 61*b*, respectively, by means of pivots 63a and 63*b*. The other ends of the links 62*a* and 62*b* are pivotally connected to the ends of yoke links 64*a* and 64*b* by means of pivots 65, essentially an axle on which the anti-rock lock 17 rotates. The other end of the yoke links 64*a* and 64*b* are pivotally connected to the driver link 66 by means of pivot 67. The other end of the driver link 66 is fixedly connected to the transverse driver bar 34, the ends of which are journaled in bushings 39 and 39 which are pressfitted into holes in the footrest linkage support arms 30 and 30.

In the use of the present invention, and referring now to FIG. 3, when handle 35 is rotated rearwardly, the transverse driver bar 34 is rotated clockwise, thereby rotating the footrest linkage driver link 50, and hence the footrest linkage driver arm 32, forwardly, the driver arm 32 thus engaging and actuating the footrest linkage assembly 15. The spring 36 aids the chair occupant in extension of the footrest 16 by exerting a generally upwardly directed force on the driver arm 32 at 38, thereby providing additional clockwise torque on the driver arm 34 in an amount equal to the product of that portion of the upwardly directed force at a right angle with respect to the driver arm 34 rotational axis and the distance between 38 and the driver arm 34 rotational axis. The footrest 16 begins rotating upwardly and forwardly, while simultaneously the landing gear anti-rock lock linkage driver link 47 is rotated downwardly, thereby engaging the linkage assembly 40 and causing the entire linkage assembly 40 to rotate downwardly and forwardly, the result being that the landing gear anti-rock lock 17 descends below the arcuate rocking surfaces 13, contacts the floor surface in a generally forwardly location, and begins to drive the front of the contour lounger 1 upwards During this deployment stage of the landing gear anti-rock lock 17, the chair occupant may aid the reclining action of the contour lounger 1, and hence the downward motion of the anti-rock lock 17, by leaning backwardly against the backrest 12, which effectively translates the occupant's center of gravity rearwardly and away from the point at which the anti-rock lock 17 contacts the floor surface. When footrest linkage assembly 15 reaches its fully extended position landing gear anti-rock lock 17 likewise assumes its fully deployed state, thereby orienting contour lounger 1 in a generally reclined position and locking the lounger against all rocking motion. The resulting reclined contour lounger 1 is completely stable as the anti-rock lock 17 in conjunction with the pair of arcuate surfaces 13 form a "3-point" type of contact with the floor surface. And, the previously described upwardly directed force generated by spring 36 upon driver arm 32 maintains the footrest linkage assembly 40 in its extended position.

To return to the non-reclined position, that is, the rocking position, the occupant need merely reverse the steps taken to place the chair in the reclined position. Otherwise expressed, the occupant simply moves the handle 35 forwardly from the position illustrated in phantom in FIG. 3 to the position illustrated in phantom in FIG. 1.

Those skilled in the art will readily recognize adaptations and modifications which may be made to the present invention which will result in a more desirable product for the consumer without departing from the spirit or scope of the invention, as defined by the appended claims.

What is claimed is:

1. A rocker recliner chair comprising a chair frame having a pair of arcuate surfaces engagable directly with a room floor, said arcuate surfaces supporting said chair for rocking movement relative to said floor, a chair seat and a chair backrest supported from said frame, a footrest movable between a retracted position generally vertically oriented and adjacent a front of said chair frame and an extended position generally horizontally oriented and forward of said front of said chair frame, said footrest being mounted upon a footrest linkage means, said footrest linkage means being mounted on said frame for moving said footrest from said retracted position to said extended position, a floor-contacting landing gear movable from a retracted position generally flush with or above said arcuate surfaces of said chair frame to an extended floor contacting position generally below said arcuate surfaces of said chair frame, said landing gear when in said extended floor contacting position being operable to force said chair into a reclining attitude, landing gear linkage means for moving said landing gear from said retracted position to said extended position, and a handle operable to simultaneously actuate said footrest linkage means and said landing gear linkage means.

2. The rocker recliner chair of claim 1 wherein said landing gear linkage means is a four bar linkage comprising a bracket being fixedly mounted to a transverse brace, a first link having a front end pivotally connected to said bracket, a second link having a front end pivotally connected to a back end of said first link, and a third link having a lower end pivotally connected to a back end of said second link and an upper end fixedly connected to said handle.

3. The rocker recliner chair of claim 1 wherein said landing gear is a wheel rotatably supported by said first and second links.

4. The rocker recliner chair of claim 1 wherein said handle is operable to place said footrest in said extended position and simultaneously place said landing gear in said extended position, said chair being caused by said landing gear when in said extended position to be maintained in a generally reclined attitude incapable of any rocking motion.

5. A recliner mechanism comprising footrest linkage means for effecting movement of a recliner footrest, and landing gear linkage means for effecting movement of a floor-contacting landing gear;

said landing gear linkage means being actuatable by said footrest linkage means and operable to deploy said landing gear as said footrest linkage means is extended, said landing gear linkage means being a four bar linkage comprising a crank link having a first end fixedly connected to a rotatable element of said footrest linkage means, a coupler link having a first end pivotally connected to a second end of said crank link, a rocker link having a first end pivotally connected to a second end of said coupler link, and a frame link having a first end pivotally connected to a second end of said rocker link and a second end pivotally connected to said first end of said crank link;

said landing gear comprising a wheel rotatably supported at said first end of said rocker link.

6. The recliner mechanism of claim 5 wherein said footrest linkage means comprises an overlapped double-V linkage.

* * * * *